US010112435B2

(12) United States Patent
Tolf

(10) Patent No.: US 10,112,435 B2
(45) Date of Patent: Oct. 30, 2018

(54) METHOD OF MANUFACTURING FOLDERS HAVING UNDER-DIMENSIONS, A MACHINE FOR SUCH A MANUFACTURE, AND A CASSETTE FOR SUCH A MACHINE AND SUCH A MANUFACTURING METHOD

(71) Applicant: BINDOMATIC AB, Stockholm (SE)

(72) Inventor: Göran Tolf, Täby (SE)

(73) Assignee: Bindomatic AB, Stockholm (SE)

( * ) Notice: Subject to any disclaimer, the term of this patent is extended or adjusted under 35 U.S.C. 154(b) by 66 days.

(21) Appl. No.: 14/921,600

(22) Filed: Oct. 23, 2015

(65) Prior Publication Data

US 2016/0144652 A1 May 26, 2016

(30) Foreign Application Priority Data

Nov. 20, 2014 (SE) ..... 1451396

(51) Int. Cl.

| | |
|---|---|
| ***B42C 13/00*** | (2006.01) |
| ***B42C 9/00*** | (2006.01) |
| ***B42F 7/14*** | (2006.01) |
| ***B42C 19/00*** | (2006.01) |
| ***B42C 11/02*** | (2006.01) |
| ***B42C 19/08*** | (2006.01) |

(52) U.S. Cl.

CPC ..... *B42F 7/14* (2013.01); *B42C 9/0056* (2013.01); *B42C 9/0093* (2013.01); *B42C 11/02* (2013.01); *B42C 13/006* (2013.01); *B42C 19/00* (2013.01); *B42C 19/08* (2013.01)

(58) Field of Classification Search

CPC ... Y10S 412/90; B42C 13/006; B42C 9/0093; B42C 9/0056

USPC ..... 412/8, 900

See application file for complete search history.

(56) References Cited

U.S. PATENT DOCUMENTS

| | | | | |
|---|---|---|---|---|
| 3,908,215 A * | 9/1975 | Watson | B42C 13/006 412/9 |
| 5,026,236 A * | 6/1991 | Otake | B42C 9/0056 412/8 |
| 5,102,277 A * | 4/1992 | Tholerus | B42C 9/0056 412/900 |

(Continued)

FOREIGN PATENT DOCUMENTS

| | | | |
|---|---|---|---|
| EP | 0390126 A2 * | 10/1990 | B42C 9/0056 |
| GB | 2294239 A * | 4/1996 | B42F 7/14 |

*Primary Examiner* — Kyle R Grabowski
(74) *Attorney, Agent, or Firm* — Nixon & Vanderhye P.C.

(57) ABSTRACT

Method of manufacturing a folder (1), which continuously or intermittently is fed through a machine (51) by a conveying means (52, 53) adapted to an ordinary folder of a nominal width dimension ($B_{nom}$), wherein said folder (1) features an under-dimension in relation to the width dimension of the ordinary folder, and that said folder (1) is placed in a cassette (40) having a dimension ($B_k$) corresponding to said under-dimension and having an outer dimension corresponding to said nominal dimension ($B_{nom}$), which cassette (40) is moved through the machine (51) by said conveying means (52, 53). As well as a machine (51) and a cassette (40) for the realization of said method.

19 Claims, 4 Drawing Sheets

(56) References Cited

U.S. PATENT DOCUMENTS

| | | | | |
|---|---|---|---|---|
| 2003/0133741 | A1* | 7/2003 | Johnstone | B42C 9/0056 402/900 |
| 2006/0099052 | A1* | 5/2006 | Johnstone | B42C 9/0056 412/900 |

* cited by examiner

METHOD OF MANUFACTURING FOLDERS HAVING UNDER-DIMENSIONS, A MACHINE FOR SUCH A MANUFACTURE, AND A CASSETTE FOR SUCH A MACHINE AND SUCH A MANUFACTURING METHOD

This application claims priority to SE Patent Application No. 1451396-4, filed 20 Nov. 2014, the entire contents of which is incorporated herein by reference.

TECHNICAL FIELD

The present invention relates to a binding technique of separate sheets into booklets/folders.

BACKGROUND OF THE INVENTION

From the Swedish patent document SE 500756, a method and a machine for the manufacture of booklets/folders by gluing a number of bundles of sheets by a continuous or intermittent process are previously known. Said bundles of sheets have defined nominal dimensions and are each one kept standing between two conveyors while they are fed forward over a heater for melting the glue.

Each such a machine is intended to handle booklets/folders of a determined nominal dimension for which the machine is designed.

To manufacture folders having under-dimensions, i.e., having dimensions that are smaller than the dimensions for which the machine is designed, is not possible in view of the guiding laterally of the bundles of sheets cannot be made. In addition, no jogging in the vertical direction of the bundles of sheets can be made.

THE OBJECT OF THE INVENTION

The object of the present invention is to, in such a known machine, be able to manufacture booklets/folders of a smaller size, i.e., having under-dimension, in order to, in such a way, extend the field of application of the machine and in that connection allow the manufacture booklets/folders smaller in size by the same gluing method as previously has been used.

Thus, the object is to present a possibility of manufacturing a plurality of different folder sizes in one and the same machine.

SUMMARY OF THE INVENTION

By the present invention, as this is seen in the independent claims, the above-mentioned objects are met, said disadvantages having been eliminated. Suitable embodiments of the invention are defined in the dependent claims.

The invention concerns a method of manufacturing a folder consisting of, on one hand, a cover having two cover sides, a back between the cover sides, and an adhesive fastened to the inside of the back, and, on the other hand, a bundle of sheets having a plurality of sheets inserted between the two cover sides of the cover and one side edges of which are brought into abutment against the inside of the back and thereby the adhesive thereof, the adhesive being activated by an activation device of a gluing machine for a predetermined time for the adhesion of the sheets to the inside of the back all while the same folder continuously or intermittently is fed through the gluing machine by a conveying means adapted to an ordinary folder of a nominal outer dimension. The manufacture of said folder features an under-dimension in relation to the ordinary folder. The folder is placed in a cassette having an inner dimension corresponding to said under-dimension and having an outer dimension corresponding to said nominal dimension, which cassette is moved through the gluing machine by said conveying means.

In one embodiment according to the invention, the cassette is moved through the gluing machine by the conveying means being provided with driver means, which are brought into abutment against at least one width means of the cassette. Said width means may either be a separately connected part of the cassette or be an especially adapted side of the cassette where the side is a side of the space of the cassette that simultaneously extends to a width outside the space, which width corresponds to a nominal outer dimension of an ordinary folder.

In one embodiment according to the invention, the driver means of the conveying means are brought into abutment against width means placed on both sides of the cassette. This implies that width means are situated on both sides of the cassette, which implies that the cassette can be centred in relation to the conveying means of the machine so that the load on the cassette from the conveying means upon move will become symmetrical.

In one embodiment according to the invention, a jogging of said plurality of sheets is made by a lid of the cassette or a jogging means being brought into abutment against said plurality of sheets. Within the scope of this embodiment, solely the inside of the lid may act as a jogging surface on the bundle of sheets or the inside of the lid may be provided with jogging means, which have an extension inward toward the cassette to reach the bundle of sheets.

In addition, the invention concerns a machine for continuous or intermittent manufacture of a folder consisting of, on one hand, a cover having two cover sides, a back between the cover sides, and an adhesive fastened to the inside of the back, and, on the other hand, a plurality of sheets inserted between the two cover sides of the cover and one side edges of which are brought into abutment against the inside of the back and thereby the adhesive thereof, the adhesive being activated by an activation device of a gluing machine for a predetermined time for the adhesion of the sheets to the inside of the back all while the folder continuously or intermittently is fed through the gluing machine by a conveying means adapted to a folder of a nominal outer dimension. The conveying means of the machine comprises laterally placed driver means, which at least on one side have a pitch corresponding to the pitch that the consecutive width means of a cassette placed in the conveying means have. With "consecutive width means", reference is made to a cassette having more than one width means placed on the cassette in the feeding direction. Alternatively, the conveying means have a pitch corresponding to the depth, $K_d$, of the proper cassette.

In those cases the machine handles a cassette having width means only on one side, the driver means concern the pitch on the same side while the other side comprises driver means having a pitch corresponding to the depth of the proper cassette.

In those cases the machine handles a cassette provided with only one width means on each side, no adaptation is needed of the conveying means of the machine but then the width means of the cassette are adapted to the existing conveying means of the machine. The activation device consists of a source of heat, which acts on a heat-sensitive glue as adhesive, which melts upon heating and which cures upon cooling.

The feed through the machine embraces both the time for melting the adhesive as well as cooling/curing the same.

In one embodiment according to the invention, the pitch of the driver means is an integral multiple of the pitch $D_k$ of the width means of the cassette. For instance, a cassette having two consecutive width means may be fitted between a 1st and a 4th driver means of the conveying means of the machine, i.e., the pitch $D_k$ of the cassette is the pitch $D_m$ of the driver means times three, $D_k=3D_m$, wherein the integral multiple is 3.

The invention also concerns a cassette for a manufacturing method according to the above, the cassette being formed with an inner space limited by walls intended to hold a folder in an essentially vertical position in the space. Said folder comprises, on one hand, a cover having two cover sides, a back between the cover sides, and an adhesive fastened to the inside of the back, and, on the other hand, a plurality of sheets inserted between the two cover sides of the cover and one side edges of which are brought into abutment against the inside of the back and thereby the adhesive thereof, the adhesive being activated by an activation device of a gluing machine for a predetermined time for the adhesion of the sheets to the inside of the back, said inner space being formed with an under-dimension in comparison with a nominal dimension of the gluing machine.

In one embodiment according to the invention, at least one side of the cassette is provided with at least one width means, which together with the cassette achieves said nominal dimension.

In one embodiment according to the invention, a first width means is connected to one side of the cassette and a second width means connected to the other side of the cassette. Depending on the dimensions, i.e., the transverse extension of these width means, the lateral location of the cassette in relation to the conveying means of the machine can be determined.

In one embodiment according to the invention, the first width means and the second width means have equally long lateral/transverse extension from the cassette. This embodiment is advantageous since it gives a symmetrical placement of the cassette in relation to the conveying means of the machine.

In one embodiment according to the invention, the cassette is open at the bottom to provide a better activation of the adhesive. Thus, the heat activation of the adhesive is not blocked by any wall in the cassette, which decreases the time of the binding cycle for each folder without needing to raise the temperature of the activation device.

In one embodiment according to the invention, the cassette is provided with grip facilitating recesses in the upper part of the walls thereof. These recesses allow a simpler manual or automatized filling and emptying process for the folders of the cassette.

In one embodiment according to the invention, the cassette is provided with a lid, preferably articulately connected via a hinge to an upper edge of a wall side of the cassette.

In one embodiment according to the invention, the lid is formed to abut against the edge of said plurality of sheets when the lid is closed. This abutment aims at jogging the sheets of the folder before the activation of the adhesive so that the result of the binding procedure becomes optimal.

In one embodiment according to the invention, one or more jogging means are arranged to continuously or intermittently abut against the upper edge of the bundle of sheets at least before the folder blank passes the activation device.

BRIEF DESCRIPTION OF THE DRAWINGS

Now, the invention will be described in more detail, references being made in connection with the accompanying drawing figures. The drawing figures show only explanatory sketches intended to facilitate the understanding of the invention.

DESCRIPTION OF THE INVENTION

Figure 1:
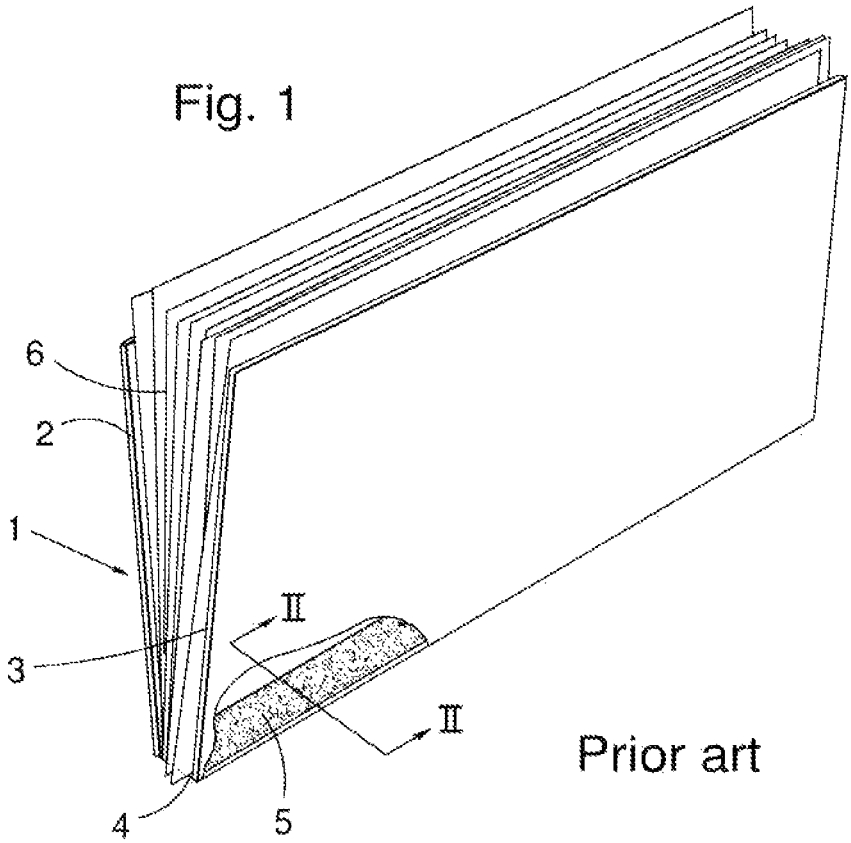
FIG. 1 shows a folder according to prior art.
Figure 2:
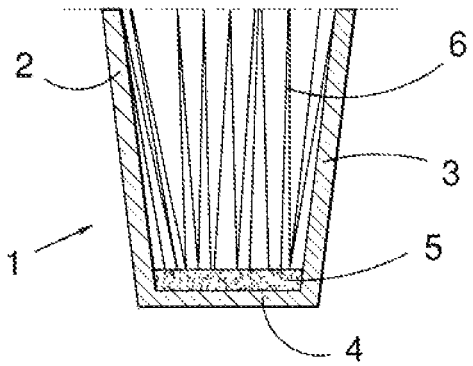
Prior art Fig. 2
FIG. 2 shows the folder according to FIG. 1 in a section.

FIG. 1 shows a conventional folder 1, which consists of two cover sides 2, 3 and a back 4 forming a cover. On the inside of the back 4, and possibly on the portions of the cover sides 2, 3 situated at the back 4, an adhesive 5 is applied and which also is comprised in the cover. The adhesive 5 may have different shapes and composition but preferably consists of a strip of hot melt adhesive provided with an essentially rectangular cross-section, i.e., a glue being solid at room temperature and semi-solid or liquid upon heating to a higher temperature. A bundle of sheets 6 consisting of a plurality of sheets of paper is in FIGS. 1 and 2 shown inserted in the cover so that a side edge of each sheet of the bundle of sheets 6 abuts against the surface of the adhesive 5 turned from the back. This folder blank undergoes a binding/gluing phase when the adhesive passes an activation device.

FIG. 2 shows a section through a part of the folder 1 the two cover sides 2, 3 of which are connected with the back 4 into a uniform cover. In the cover, the adhesive 5 is placed, which upon heating in the activation device entails that the bundle of sheets 6 falls down into the adhesive, which upon cooling cures and becomes solid, wherein the bundle of sheets 6 will become fixed to the cover.

As seen in FIG. 1, the sheets of the bundle of sheets 6 are not collected but this is made by a jogging at some instant of time in the binding process before the activation of the adhesive 5.

Figure 3:
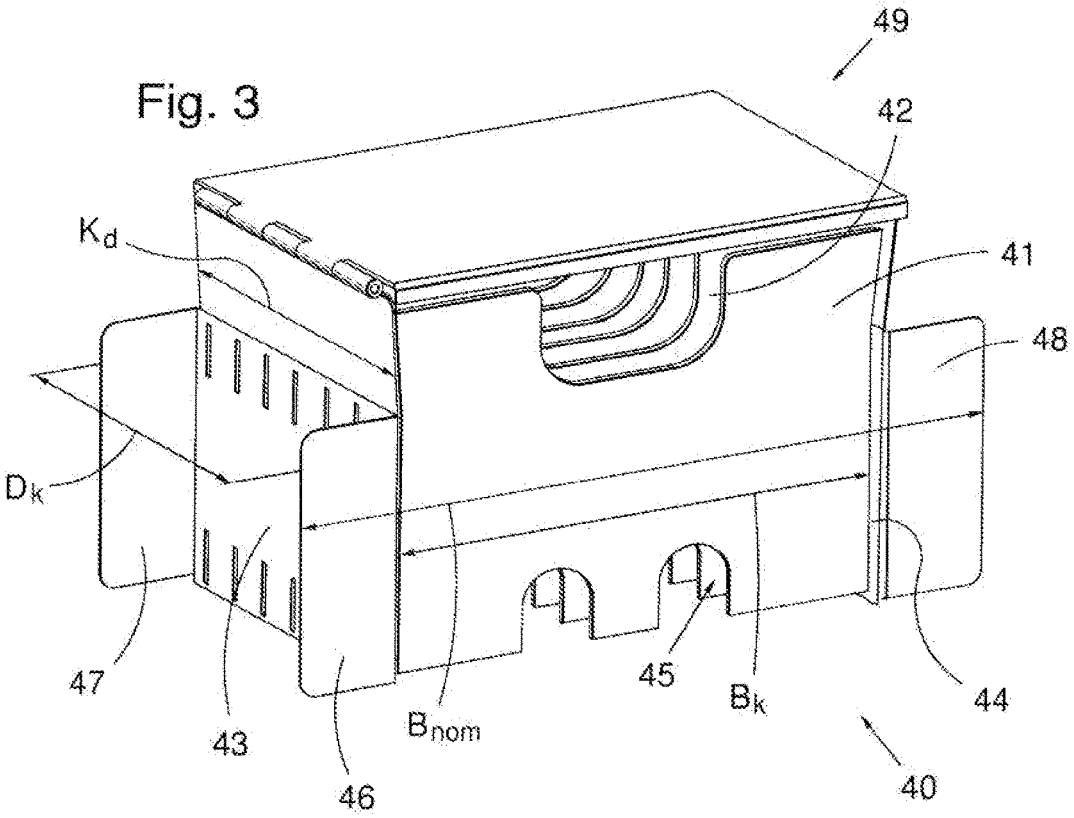
FIG. 3 shows a perspective view of a cassette according to the invention.

FIG. 3 shows a cassette 40 according to the invention. The cassette 40 comprises a front wall 41 and at least one rear wall 42 and a first side wall 43 and a second side wall 44, which walls delimit an inner space 45 in the cassette 40. The first side wall 43 is provided with two first width means 46, 47 and the second side wall 44 is provided with two second width means 48, 49 (the rear one is hidden in the figure). Furthermore, the figure shows the pitch $D_k$, i.e., the consecutive distance between the two width means 46, 47 of one side of the cassette 40. Also the depth $K_d$ of the cassette is shown in the figure. The width $B_k$ of the space, which generally corresponds to the external width dimensions of the cassette apart from the material thickness, is an under-dimension in relation to the nominal width $B_{nom}$ of the machine. This implies that for a machine having the nominal width dimension $B_{nom}$, folders having an under-dimension in relation to the folder size for which the machine essentially is intended can be produced. The space 45 of the cassette is open at the bottom, at least partly, to allow an effective action of the activation device.

Figure 4:
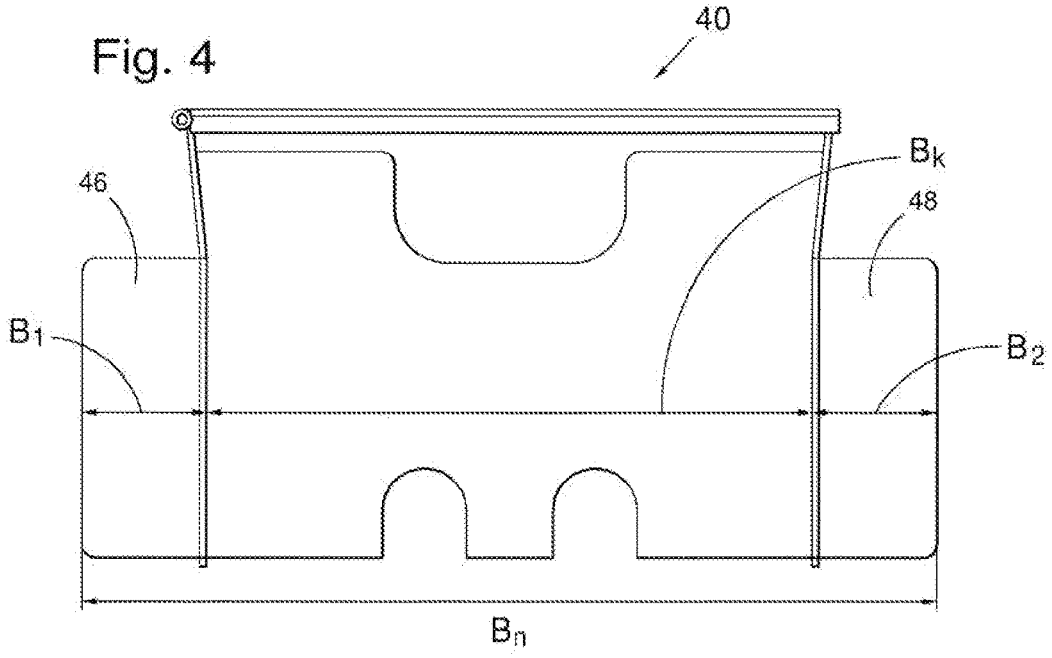
FIG. 4 shows a front view of the cassette according to FIG. 3.

FIG. 4 shows the cassette 40 in front view with the external width dimension $B_k$ of the space of the cassette as well as the width extension $B_1$ of one width means 46 as well as the width extension $B_2$ of the other width means 48. The sum $B_k+B_1+B_2$ is equal to the nominal width dimension $B_n$ of the machine, i.e., the folder format for which the machine essentially is designed.

Figure 5A:
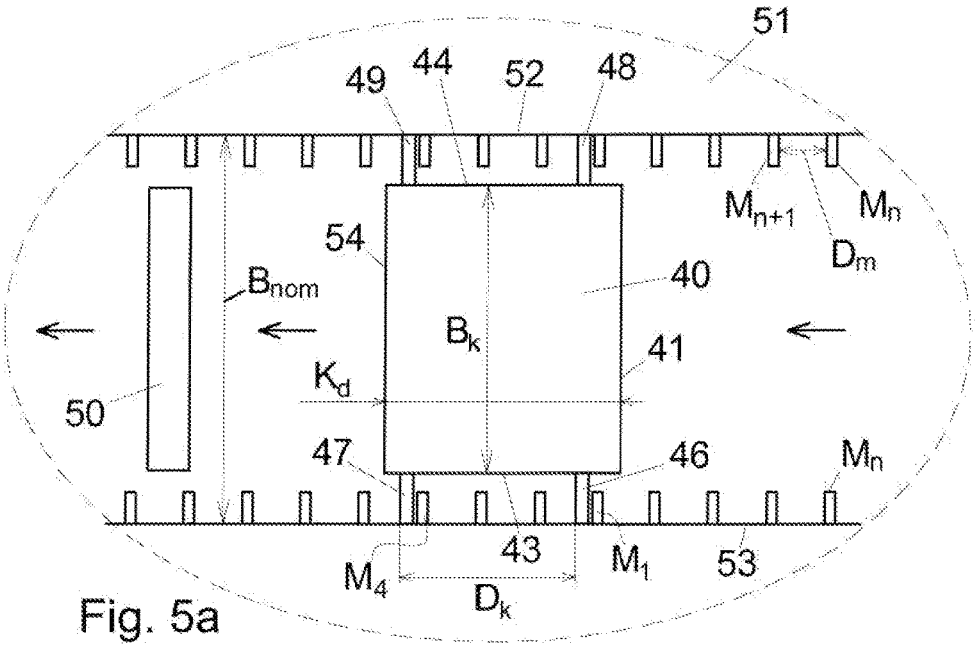
FIG. 5*a* schematically shows a part of the machine with a cassette according to a first embodiment of the invention.

FIG. 5*a* schematically shows a machine 51 provided with conveying means 52, 53 according to the invention. The figure shows the cassette 40 introduced in a machine 51 for the gluing/binding between the conveying means 52, 53 of the machine each one of which is provided with a plurality of driver means $M_n$, which are oriented inward toward the cassette 40 at a pitch $D_m$ between each adjacent driver means, i.e., the distance from $M_n$ to $M_{n+1}$ in the feeding direction indicated by the arrows in the figure is $D_m$ and is constant along the entire conveying means. Each one of the two sides 43, 44 of the cassette is provided with two width means 46, 47 and 48, 49, respectively. The width means 46, 47, 48, 49 are either connected to the sides of the cassette 40 as in the figure or constitute an extension of the front side 41 or the rear side 54 toward the respective conveying means 52, 53. The consecutive distance between two width means 46, 47 is indicated by the pitch $D_k$, which also has been shown in FIG. 3. As seen in FIG. 5, the pitch $D_m$ of the driver means is an integral multiple of the pitch $D_k$ of the width means of the cassette, which for the example in the figure is 3, $D_k=M_4-M_1$. That is, $D_k=3$ if $D_m=1$. The figure also shows that the width B of the cassette 40 constitutes an under-dimension in relation to the nominal width dimension $B_{nom}$. The depth of the cassette is indicated by the dimension $K_d$. Furthermore, the figure shows the activation device 50, which heats up the adhesive of the cover for the adhesion of the sheets when the cassette passes the activation device.

Figure 5B:
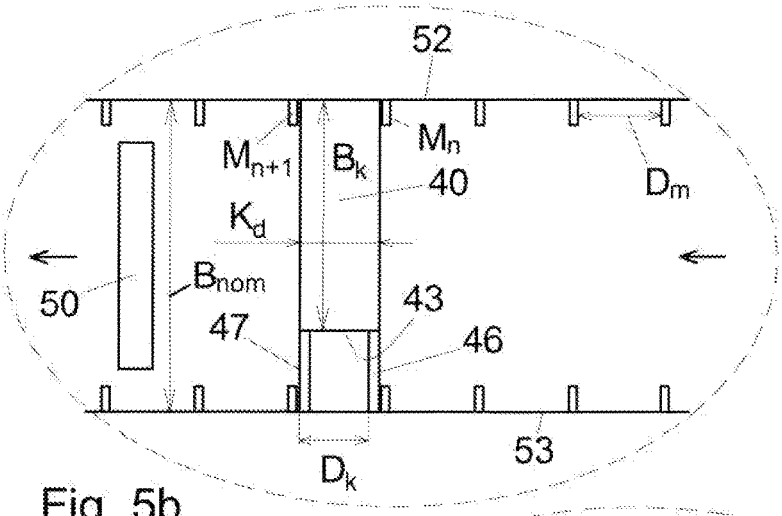
FIG. 5*b* schematically shows a part of the machine with a cassette according to a second embodiment of the invention.

FIG. 5*b* shows an alternative embodiment of the cassette 40 and the conveying means 52, 53, wherein the cassette only is provided with width means 46, 47 on one side 43 thereof. In such an embodiment, $D_m$ is slightly greater than the pitch $D_k$ corresponding to the depth of the cassette so that one side of the cassette can be housed between two adjacent driver means $M_n$, $M_{n+1}$. The embodiment further shows that the width $B_k$ of the cassette together with width means 46, 47 corresponds to the nominal width $B_{nom}$. Furthermore, the figure shows the activation device 50, which heats up the adhesive of the cover for the adhesion of the sheets when the cassette passes the activation device. The depth of the cassette is indicated by the dimension $K_d$ as in FIG. 5*a* and is slightly smaller than $D_m$ to fit in between the driver means $M_n$.

Figure 5C:
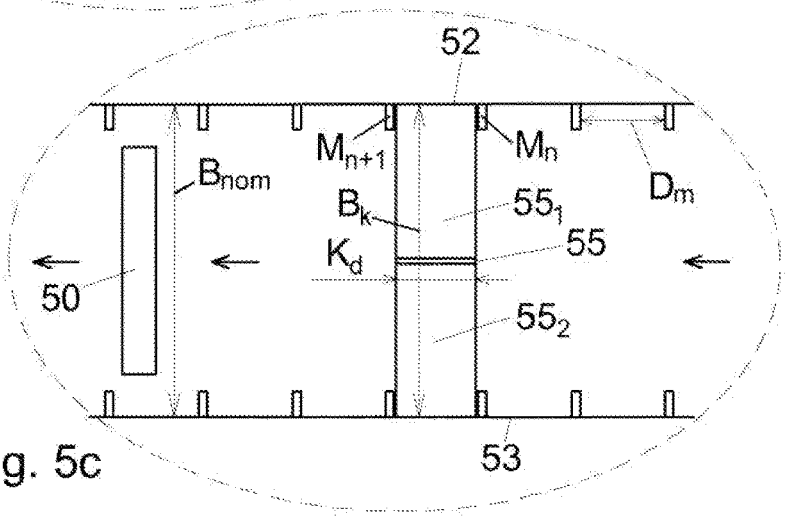
FIG. 5*c* schematically shows a part of the machine with a cassette according to a third embodiment of the invention.

FIG. 5*c* shows an additional alternative embodiment of the cassette 55, wherein the cassette 55 comprises two separate chambers $\mathbf{55}_1$, $\mathbf{55}_2$, which in this embodiment have been shown with dimensions for equally large folder blanks, the total width $B_k$ of the cassette corresponding to the nominal distance $B_{nom}$ between the conveying means 52, 53. The chambers may naturally be made differently large within the frame of their total width $B_k$. The dimension of the depth $K_d$ of the cassette is in this embodiment slightly smaller than $D_m$ for the cassette to be able to fit in between two adjacent driver means $M_n$, $M_{n+1}$. Furthermore, the figure shows the activation device 50, which heats up the adhesive of the cover for the adhesion of the sheets when the cassette passes the activation device.

Figure 6:
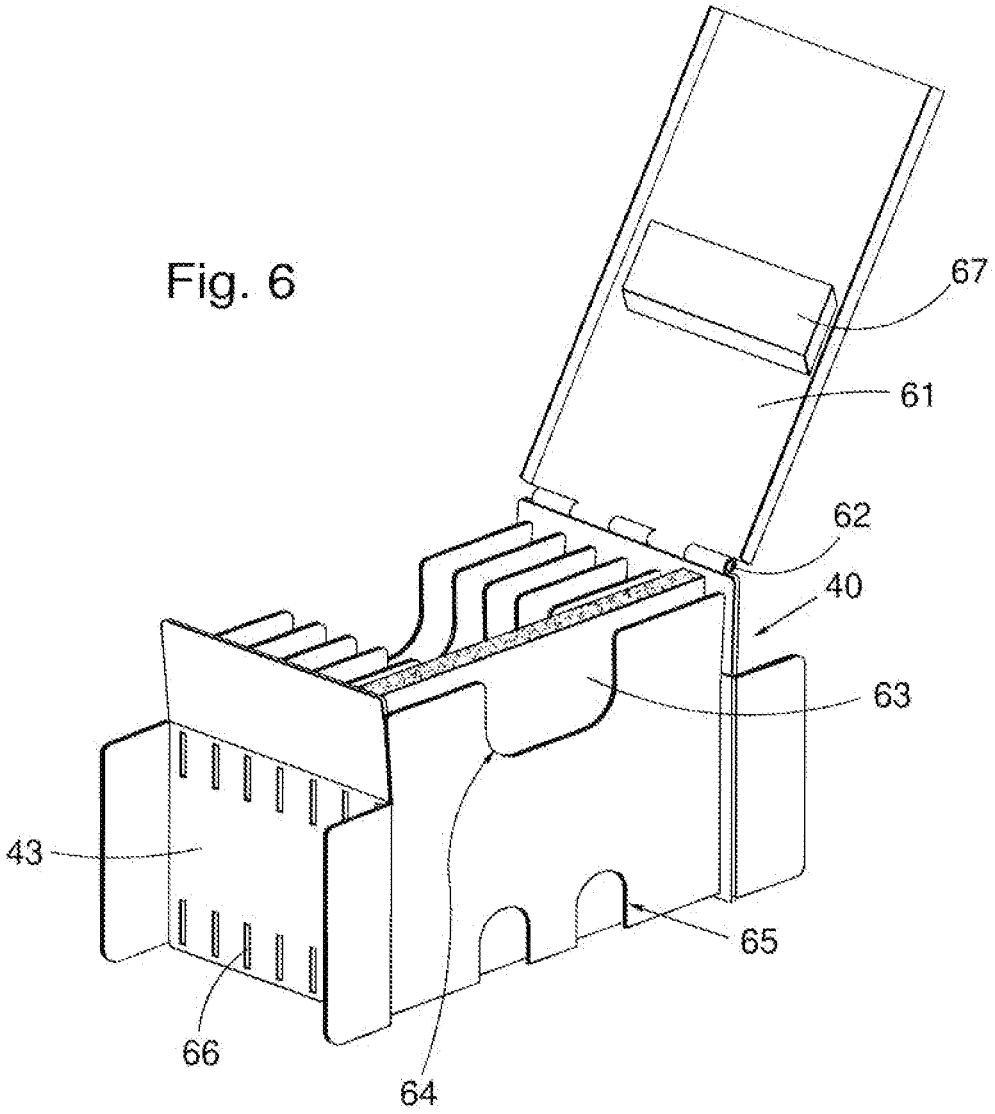
FIG. 6 shows in perspective a folder inserted in an open cassette according to the invention.

FIG. 6 shows a cassette 40 corresponding to the cassette shown and described under FIGS. 3 and 4. The cassette is provided with a lid 61, which is articulately connected, via a hinge 62, to one side's upper edge of the cassette 40. When the lid 61 is open as in the figure, the cassette can be loaded with covers together with a bundle of sheets, which together constitute the folder blank 63. For picking in folder blanks 63 into the cassette 40, the same is provided with gripping recesses 64 in the upper edge of the cassette wall. The cassette is furthermore provided with sensor openings 65 and mounting slots 66 in the side walls 43 thereof. The sensor openings 65 serve the purpose of allowing to identify which type of folder that is inserted. The inside of the lid 61 may in addition be provided with one or more jogging means 67, which have the purpose of evening up the upper edge of the bundle of sheets before gluing. Also other types of jogging means which are not fitted onto the lid of the cassette but are arranged for co-operation with cassettes without lids are feasible within the scope of the invention. The mounting slots make it possible to vary the spaces of the cassette so that folders having different thickness can be handled by the same cassette. For thicker folders, some walls are removed, and for thinner folders, all walls are put in place. The shown cassette can handle maximally six thinner folders.

In other feasible embodiments, the cassettes may be formed with partition walls that are continuously displaceable to afford support to thin folders as well, in combination with thick folders.

The invention claimed is:

1. A method of manufacturing a first folder having a first width dimension using a folder manufacturing machine configured to manufacture a second folder having a second width dimension that is greater than the first width dimension, the first folder comprising a cover having two cover sides, a back between the cover sides, an adhesive on the inside of the back, and a bundle of sheets inserted between the two cover sides of the cover and one side edges of which are brought into abutment against the inside of the back and the adhesive, the method comprising:

activating the adhesive by an activation device of the folder manufacturing machine for a predetermined time for the adhesion of the bundle of sheets of said first folder to the inside of the back; and while the adhesive is activated for the adhesion of the bundle of sheets to the inside of the back, continuously or intermittently feeding the first folder through the folder manufacturing machine by a conveyer adapted to the second folder having the second width dimension, wherein said first folder is placed in a cassette having an inner dimension corresponding to said first width dimension and having an outer dimension corresponding to said second width dimension, and the cassette is moved through the folder manufacturing machine by said conveyer.

2. The method according to claim 1, wherein the cassette is moved through the machine by the conveyer including a driver, the driver being brought into abutment against at least one width extender of the cassette or against the cassette.

3. The method according to claim 2, wherein the driver of the conveyer is brought into abutment against width extenders placed on both sides of the cassette.

4. The method according to claim 1, wherein a jogging of said bundle of sheets is made by a lid of the cassette or a jogging means being brought into abutment against said bundle of sheets.

5. The method according to claim 1, wherein the cassette includes a lid, articulately connected via a hinge to an upper edge of a wall side of the cassette.

6. A cassette for the method of manufacturing the folder according to claim 1, wherein the cassette is formed with an inner space limited by walls intended to hold the first folder in an essentially vertical position in the space, said inner space being formed with the first width dimension.

7. The cassette according to claim 6, wherein at least one side wall of the cassette is provided with at least one width extender, which together with the cassette achieves said second width dimension of the second folder manufactured by the same machine.

8. The cassette according to claim 7, wherein a first width extender is connected to one side of the cassette, and a second width extender is connected to the other side of the cassette.

9. The cassette according to claim 8, wherein the first width extender and the second width extender have equally long lateral extension from the cassette.

10. The cassette according to claim 6, wherein the cassette is open at the bottom to provide activation of the adhesive.

11. The cassette according to claim 6, wherein the cassette is provided with gripping recesses in the upper part of the walls thereof.

12. The cassette according to claim 6, wherein one or more jogging means are arranged to continuously or intermittently abut against the upper edge of the bundle of sheets at least before the folder blank passes the activation device.

13. The cassette according to claim 6, wherein the lid includes an extending portion on an inner surface of the lid to abut against the edge of the bundle of sheets when the lid is closed.

14. A cassette for manufacturing a first folder by being moved through a folder manufacturing machine configured to manufacture a second folder having a second width dimension that is larger than the first width dimension, the first folder comprising a cover having two cover sides, a back between the cover sides, an adhesive on the inside of the back, and a bundle of sheets inserted between the two cover sides of the cover and one side edges of which are brought into abutment against the inside of the back and the adhesive, the cassette comprising:

an inner space limited by walls intended to hold the first folder in an essentially vertical position in the space, said inner space having the first width dimension; and a lid, articulately connected via a hinge to an upper edge of a wall side of the cassette.

15. The cassette according to claim 14, wherein the lid is configured to abut against the edge of said bundle of sheets when the lid is closed.

16. The cassette according to claim 14, further comprising a first extender provided on one side of the cassette and a second extender provided on an opposite side of the extender, the first and second extenders extending the outer width dimension of the cassette to correspond to the second width dimension of the second folder manufactured by the folder manufacturing machine.

17. The cassette according to claim 16, wherein the first and second extenders are configured to abut drivers of a conveyer adapted to the second width dimension of the second folder manufactured by the folder manufacturing machine and the drivers of the conveyer are configured to continuously or intermittently move the cassette.

18. A system comprising:

a folder manufacturing machine; and a cassette configured to manufacturing a first folder by being moved through the folder manufacturing machine, the first folder comprising a cover having two cover sides, a back between the cover sides, an adhesive on the inside of the back, and a bundle of sheets inserted between the two cover sides of the cover and one side edges of which are brought into abutment against the inside of the back and the adhesive;

wherein the folder manufacturing machine is configured to manufacture a second folder having a width dimension, the folder manufacturing machine comprising a conveyer including a plurality of drivers equally spaced along the conveyer, and an activation device configured to activate, for a predetermined time and while the second folder is continuously or intermittently fed through the machine, an adhesive for the adhesion of sheets to an inside of a back of the second folder; and wherein the cassette comprises:

an inner space limited by side walls configured to hold the first folder in an essentially vertical position in the space, said inner space having a width corresponding to a width dimension of the first folder;

a plurality of width extenders provided on a same side wall or opposite side walls of the cassette and configured to engage the drivers of the conveyer, the width extenders extending the width of the cassette defined by the side walls to a width dimension of the second folder; and a lid articulately connected via a hinge to an upper edge of one side wall of the cassette.

19. The system of claim 18, wherein the drivers have a pitch corresponding to a pitch of consecutive width extenders of the cassette provided on one side wall of the cassette or to a depth of the cassette.

* * * * *